US010188889B2

(12) United States Patent
Zaykov et al.

(10) Patent No.: US 10,188,889 B2
(45) Date of Patent: Jan. 29, 2019

(54) METHOD AND DEVICE FOR PHYSICAL TRAINING—A TRAINING MACHINE

(71) Applicants: Georgi Ivanov Zaykov, Sandanski (BG); Ivan Georgiev Zaykov, Sandanski (BG); Tsvetan Georgiev Zaykov, Sandanski (BG)

(72) Inventors: Georgi Ivanov Zaykov, Sandanski (BG); Ivan Georgiev Zaykov, Sandanski (BG); Tsvetan Georgiev Zaykov, Sandanski (BG)

( * ) Notice: Subject to any disclaimer, the term of this patent is extended or adjusted under 35 U.S.C. 154(b) by 45 days.

(21) Appl. No.: 15/151,003

(22) Filed: May 10, 2016

(65) Prior Publication Data

US 2017/0173377 A1 Jun. 22, 2017

(30) Foreign Application Priority Data

Dec. 21, 2015 (BG) ..... 112189

(51) Int. Cl.

| | |
|---|---|
| ***A63B 5/22*** | (2006.01) |
| ***A63B 71/00*** | (2006.01) |
| ***A63B 23/04*** | (2006.01) |
| ***A63B 24/00*** | (2006.01) |
| *A63B 22/00* | (2006.01) |

(52) U.S. Cl.

CPC ..... *A63B 5/22* (2013.01); *A63B 23/0405* (2013.01); *A63B 24/0087* (2013.01); *A63B 71/0054* (2013.01); *A63B 2022/0092* (2013.01); *A63B 2023/0411* (2013.01); *A63B 2071/0063* (2013.01); *A63B 2071/0081* (2013.01); *A63B 2220/35* (2013.01); *A63B 2220/36* (2013.01); *A63B 2225/093* (2013.01)

(58) Field of Classification Search

CPC ... A63B 5/22; A63B 23/0405; A63B 71/0054; A63B 2022/0092; A63B 2023/0411; A63B 2071/0081

See application file for complete search history.

(56) References Cited

U.S. PATENT DOCUMENTS

| | | | | | |
|---|---|---|---|---|---|
| 3,797,825 | A * | 3/1974 | Barrett | A63B 5/22 | 482/81 |
| 4,968,028 | A | 11/1990 | Wehrell | | |
| 5,470,296 | A * | 11/1995 | Welte | A63B 5/22 | 482/79 |
| 5,496,204 | A * | 3/1996 | Brown | A63B 5/22 | 273/440 |
| 5,888,179 | A * | 3/1999 | Singhal | A63B 5/22 | 434/247 |
| 5,931,766 | A * | 8/1999 | Cooper | A63B 5/22 | 446/247 |
| 2005/0020413 | A1* | 1/2005 | Rudell | A63B 5/20 | 482/81 |

FOREIGN PATENT DOCUMENTS

| | | |
|---|---|---|
| WO | 2015032937 A1 | 3/2015 |

* cited by examiner

*Primary Examiner* — Sundhara Ganesan
(74) *Attorney, Agent, or Firm* — Maier & Maier, PLLC

(57) ABSTRACT

A method and apparatus for physical exercises and, in particular, for training the movements "jump" and "squat" from spot for training. The method and apparatus can have the "jump" and "squat" motions follow into a continuous alternating sequence as a response to a passing via a training spot in the same continuous alternating sequence of a lower obstacle, obligating the performance of "jump", and of the upper obstacle obligating the performance of "squat".

15 Claims, 7 Drawing Sheets

METHOD AND DEVICE FOR PHYSICAL TRAINING—A TRAINING MACHINE

FIELD OF THE INVENTION

Figure 1:
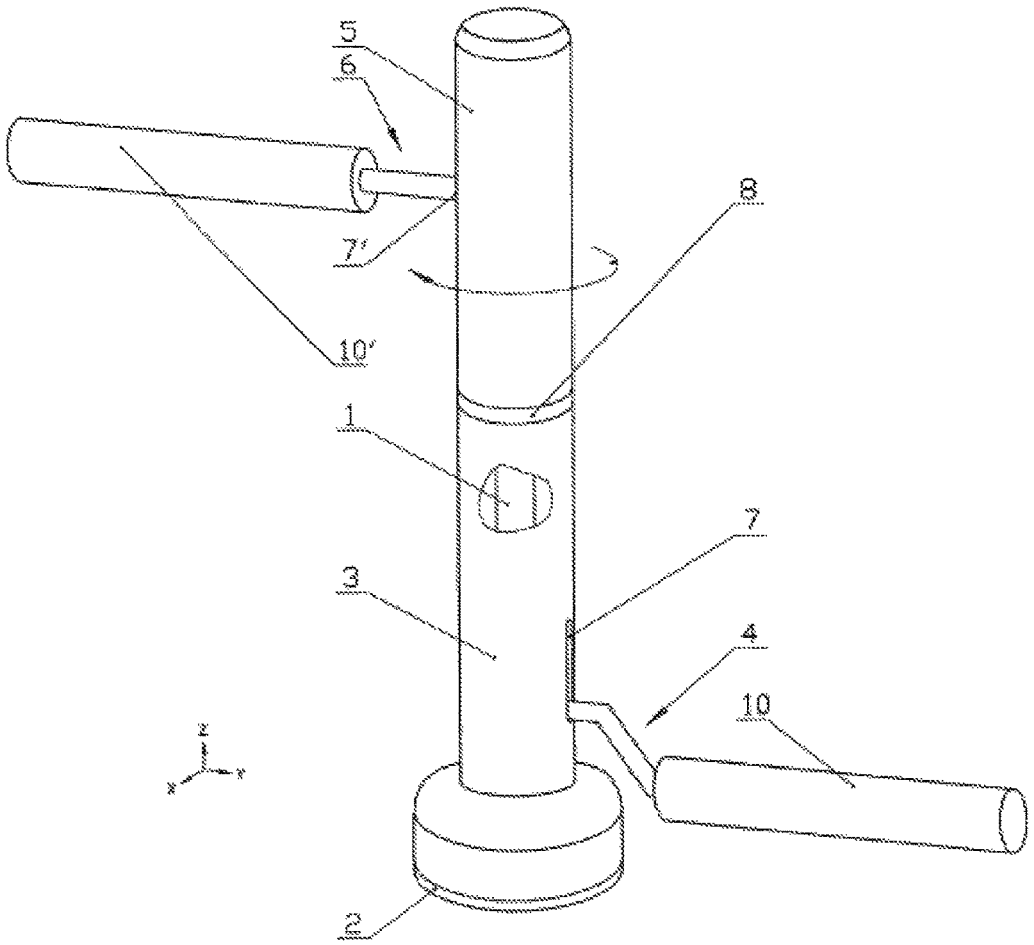

The present invention relates to a method and device for physical exercises, in particular such including jump and squat, and is designated for use in the fitness field for a functional training and good condition.

PRIOR ART

The training of jump and squat or more precisely of "jump from squat" is known and represents the so called "an exercise with the own weight" where the mass and the will of the human, executing the exercise participate only. To improve the effect of the workout, the exercise is carried out and with aggravating the own weight with additional burdens such as heavy vests, discs, ropes and other, that are offered in the trade network. The disadvantage of this training method is the lack of external stimulus, at which the will of human weakens and usually these workouts terminate without reaching an optimum training degree.

One of the oldest and so far used appliances for training of "jumping" is the rope which belongs to the so called "devices for a home workout". It is suitable for every age, can be used at any time and any place, strengthens much systems in the human organism as cardiovascular, respiratory, excretory, trains muscles especially those of the legs and arms, trains vestibular system, improves flexibility and the coordination of movements. In this type of physical exercises the combination with a squat is missing or occurs randomly.

U.S. Pat. No. 4,968,028 describes an appliance for training of vertical jump whatever ability is required in sports such as: volleyball, basketball, football, diving off or on a snow, and includes a platform for jumping, a belt to be attached to the waist of the person which conducts the workout and elastic cords that connect the said belt with the platform, as the resistive force of the cords may be adjusted and balanced. The training method itself is "jump from squat" type with overcoming of the resistive forces of the elastic cords, i.e. exercises of the type "using of own weight" with an additional hindering in result of the resistive forces of the elastic cords.

Patent Application WO2015/032937 describes an exercise device in the form of polyhedral module, consisting of different in height and slant surfaces—walls of the module, that is fastened immovably to floor. Each wall of the module serves as a support for the person that trains, when performs the respective exercise. The device allows performing a different exercises depending on the chosen height or slant, including jumps and squats. The device itself is stationary and passive in regard to the training process, which again depends solely of the will of the person that trains.

SUMMARY OF THE INVENTION

Although the described above solutions, known from the prior art, to perform their designation, they are not sufficiently effective as training machine, in respect of the movement "jump-squat" because they are passive and without taking into account the will of the person that trains, they does not stimulate training process.

Aim of the present invention is the achievement a functionally level of training and condition, namely: strength, stamina, alacrity, motion reaction, concentration and coordination as well as general physical and organ strengthening of the person that trains through effectively using of the motions "jump" and "squat".

For achieve the foregoing aim, a task of the present invention is—to provide a method for training of the "jump-squat" motion and a device for implementing the method through an harmonized active reciprocity between the device and the person that trains, in respect to the kinetics and dynamics of the process of training.

According to the invention this task is solved by a method for training of the movements "jump" and "squat" from a spot for training, as a said movements follow in continuous alternative sequence in response of the passing through the spot of training, in the same continuous alternative sequence of the obstacles—lower obstacle, obligating the performance a "jump" and top obstacle obligating the performance a "squat". In that, the motions "jump" and "squat" follow automatically in "jump-squat" cycles predetermined. The obstacles passing via the training spot perform circular motions, as are chase one another and describe parallel one to another planes with a distance between the planes in the range of an human height.

The task of the invention is solved more and by a device for a training of the "jump-squat" motion according to the aforementioned method, as is described in the Independent claim 1, as characterized with one vertical console, monolithically connected with a base, a lower bushing disposed on the console at lower end the same, and above the base, an upper bushing disposed on the console at the upper end the same, connected immovably with the lower bushing through an intermediate bushing, and bearing supports with a possibility of rotation around the console, a mechanism for jump, connected with the lower bushing and mechanism for squat, connected with the upper bushing, a lower system for adjustment, connected with the mechanism for jump, a upper system for adjustment, connected with the mechanism for squat, a system for drive of the device, disposed on the base and a system for an emergency stop, connected with the system of drive and disposed above it.

The task is solved and with that, that the both mechanisms, respectively for jump and for squat, are disposed antipodal one to another, so that when the bushings are rotated, they chase itself and they are arriving one after other in respect to the spot of training. Furthermore, the mechanism for jump is filled in the form of a tube, flexed at an angle greater than 90°, as one of its ends enters in a notch of the lower bushing, and its other end is free and is disposed in parallel to the spot for training, as this free end is provided with soft shell, while the mechanism for squat is filled in the form of a straight tube, one end of which enters in a notch of the upper bushing and the other one is free, and also is provided with soft shell.

Further, the task is solved and with that, that the end of the straight tube of the mechanism for squat is provided with one first upper support and is connected with an upper bearing bush via a swivel, as one end of the upper bearing bush is connected with the upper bushing through a notch, and its other end forms a lower support, disposed under the swivel and a second upper support, as between said first and second supports has a compression spring.

The task is solved and with that, that the lower system for adjustment is disposed inside of the lower bushing and includes a set of: a lower guide, the both ends of which are connected immovably with the lower bushing, a lower bearing bush, which comprehends the lower guide, with a possibility to move over it, as the lower end of the bearing bush is connected with the mechanism for jump through a notch, and a support bushing with a set screw, which comprehends also and the lower guide, disposed over the lower bearing bush as stops the same on the pre-determined height, and a tension spring, placed between an inside console and a lateral console.

Respectively, the upper system for adjustment is disposed inside the upper bushing and includes a set of: an upper guide, connected immovably with the upper bushing via inside consoles of the upper bushing, and upper bearing bush, which comprehends the upper guide, with possibility to move over it, as the upper end of the bearing bush is connected with the mechanism for squat through the notch of the upper bushing, and its lower end is provided with a set screw.

Further, the drive system comprises an electric motor with in-built solenoid brake and reducer, positioned at the lower end of the console, a drive gear connected to the outgoing shaft of the reducer, a driven gear, installed at the lower end of the console, coaxially to it, through bearing support and engaged with the drive gear, and a friction clutch, connecting mechanically the driven gear with the lower bushing of the training machine.

The friction clutch includes arranged coaxially on the vertical console, between the driven gear and the lower end of the lower bushing, one bushing, a leading disk with longitudinal grooves installed movably into the cylindrical part of the bushing, rotating simultaneously with it and pressed with springs to one disk to be leaded, as the latter is mounted to the lower surface of the lower bushing, pegs on the upper front surface of said bushing, disposed into the grooves of the leading disk, one adjusting nut, rolled up in a part with thread on said bushing, as the lower end of the springs are provided with spherical nozzles, that are in contact with the said conical beds, disposed on the upper surface of the adjusting nut.

The diameter and number of the conical beds match to the diameter and number of spherical nozzles.

The system for an emergency stop comprises a toothed disk, disposed coaxially on the vertical console and mounted to the disk to be leaded of the friction clutch, as well as a first inductive sensor and second inductive sensor operating together with the toothed disk, as both the sensors are mechanically connected with the base of the training machine, and electrically with a microprocessor control, which receives a signal for emergency braking from the first inductive sensor, when occurs a drop in the rotational speed of the lower and upper bushings of the device, or rotation lacks.

Basic advantage of the invention is that it to a great extent simulates the movements, carried out at a rope jumping and thus providing all unarguably benefits, stated above, of the training process with the device.

BRIEF DESCRIPTION OF THE APPLIED DRAWINGS

Figure 2:
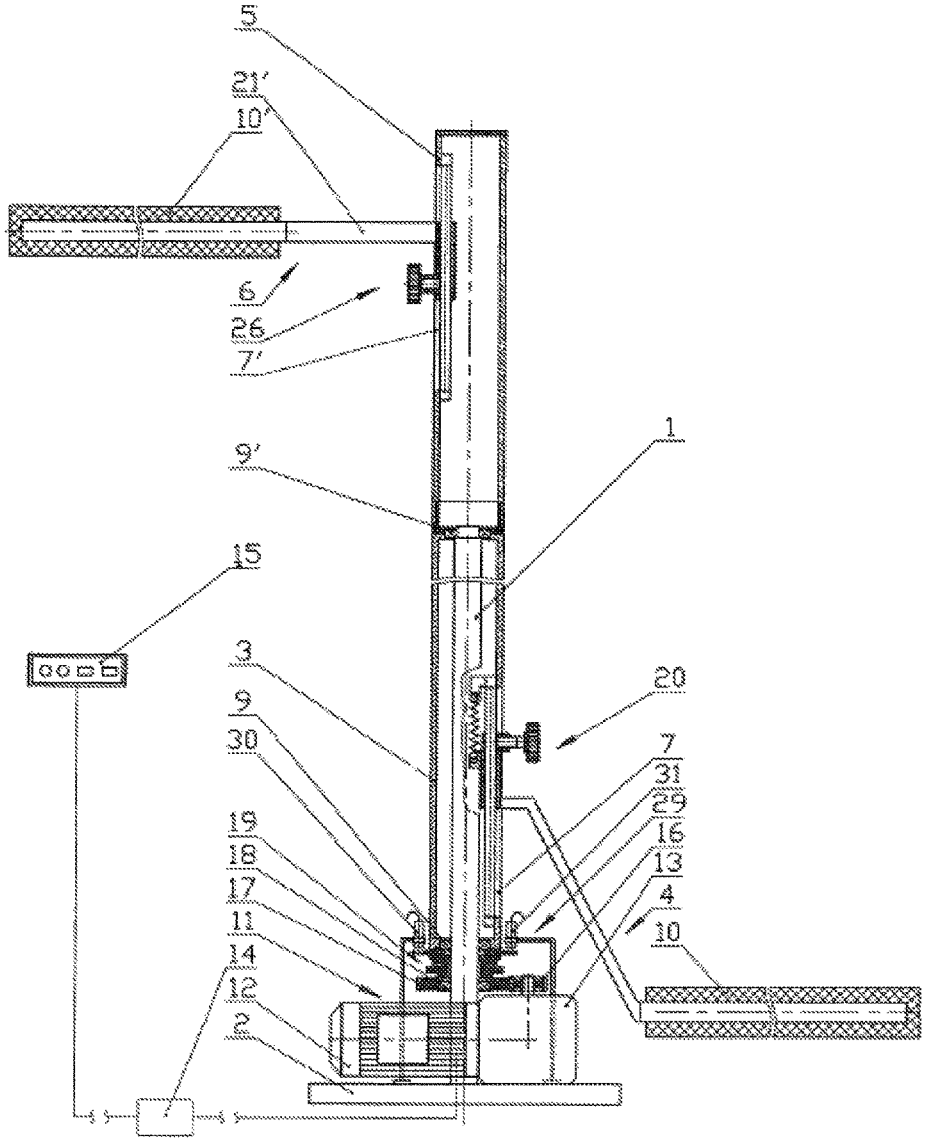
Figure 3:
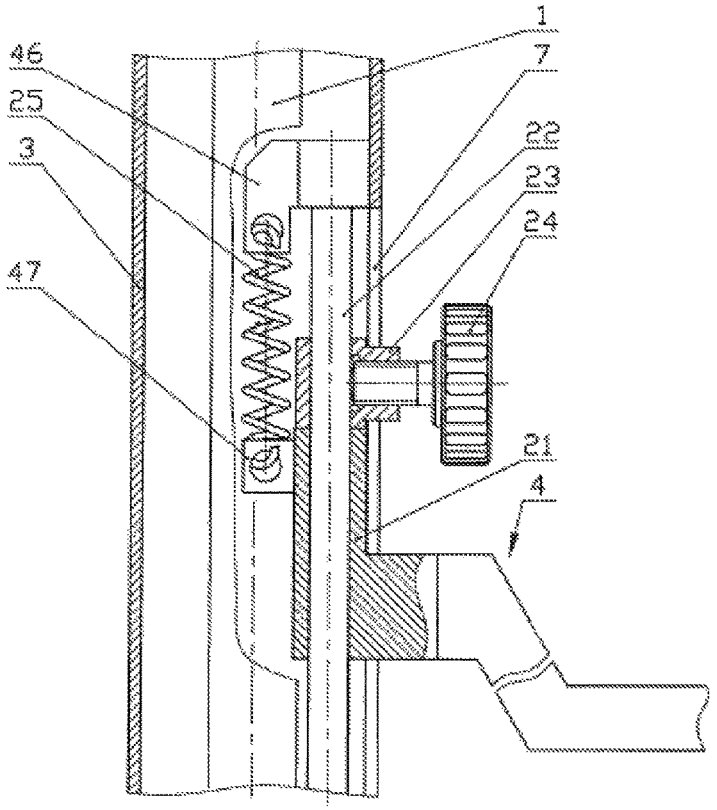
Figure 4:
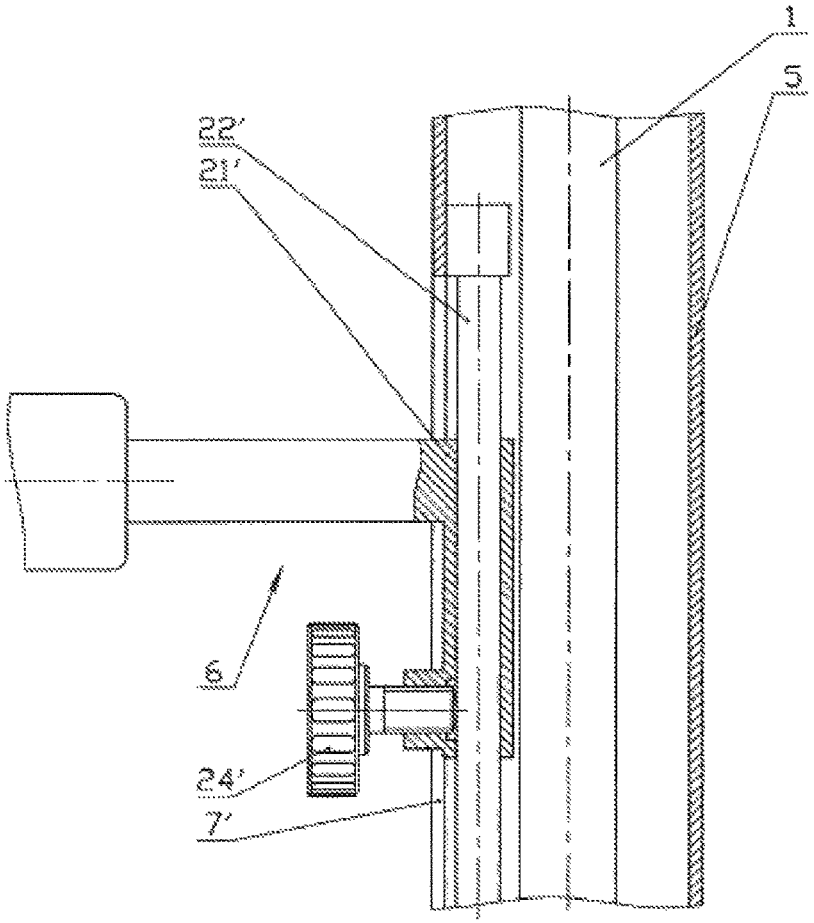
Figure 5:
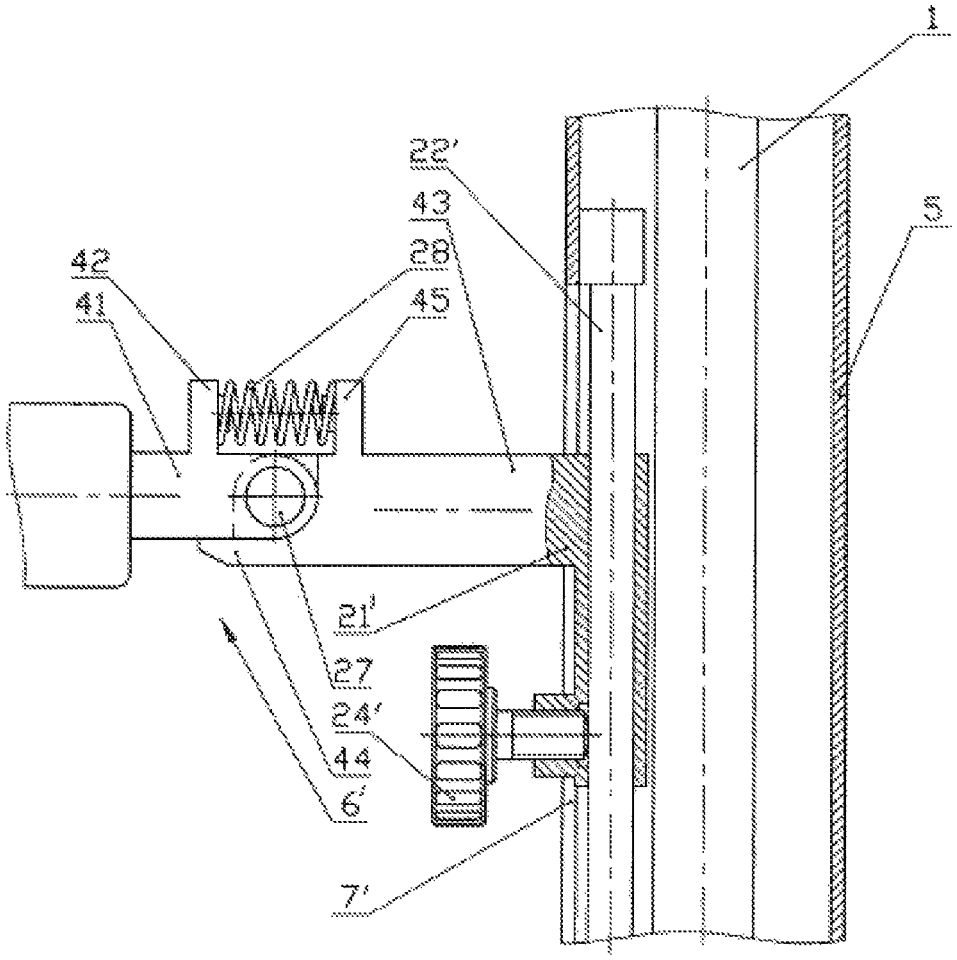
Figure 6:
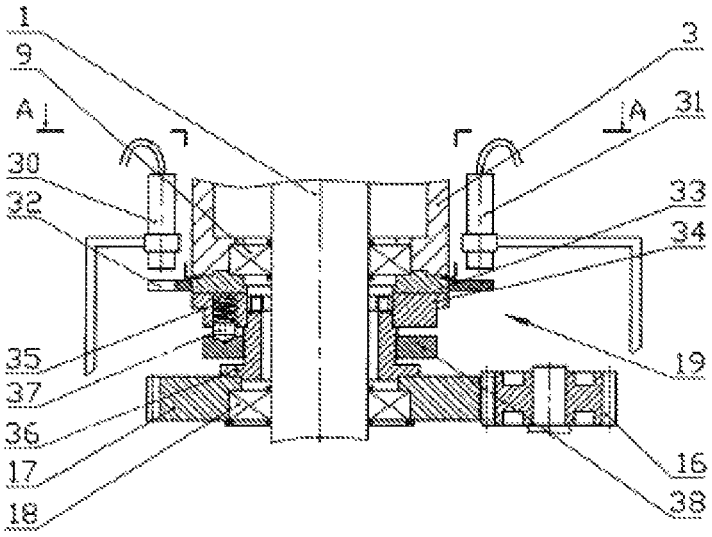
Figure 7:
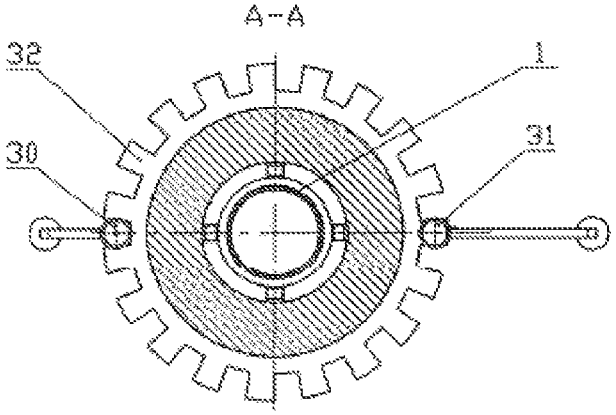
Figure 8:
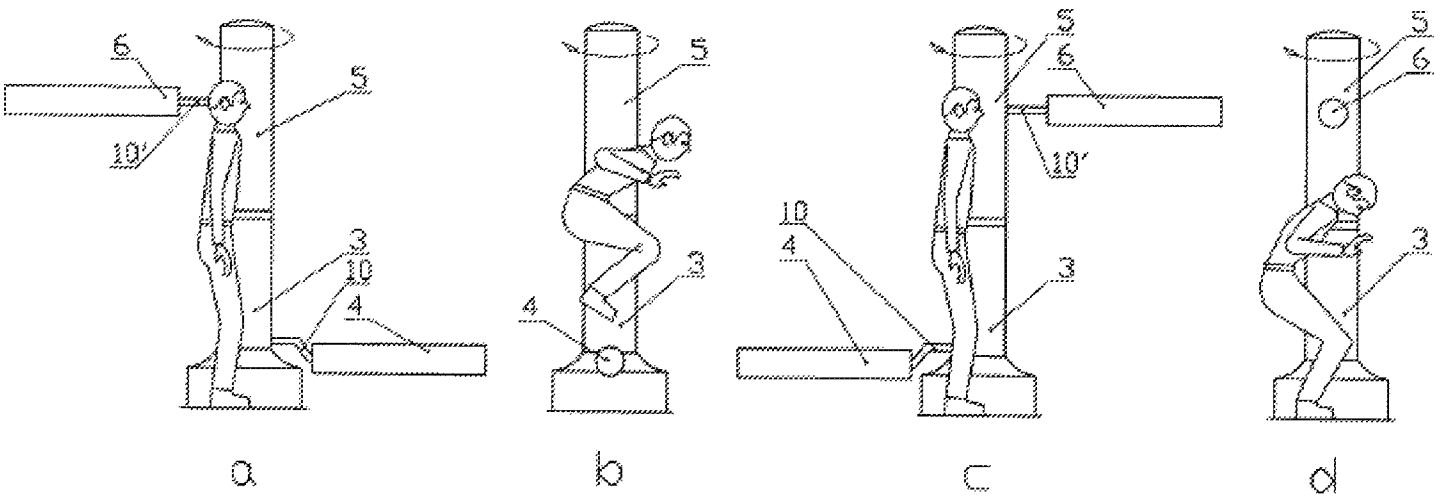

The present invention and its technical features, and advantages will be better understood in the following detailed description viewed along with the attached drawings, where:

FIG. 1 presents a common view of the device for physical exercises according to the invention;

FIG. 2 presents a longitudinal section of the device in FIG. 1 according to the invention;

FIG. 3 presents a longitudinal section of the lower system for adjustment together with the a mechanism for jump of the device of FIG. 1 and FIG. 2, according to the invention;

FIG. 4 presents a longitudinal section of the upper system for adjustment together with the mechanism for squat of the device in FIG. 1 and FIG. 2, according to the invention;

FIG. 5 presents a longitudinal section of one variant embodiments of the upper system for adjustment together with the a mechanism for squat of the device of FIG. 1 and FIG. 2, according to the invention;

FIG. 6 presents a longitudinal section of the system for drive and of the system for an emergency stop of the device of FIG. 2, according to the invention;

FIG. 7 presents a cross section on a line A-A of the system for an emergency stop of FIG. 6, according to the invention; and FIG. 8 illustrates a training process with the device, according to the invention.

EXAMPLES FOR THE EMBODIMENT OF THE INVENTION

The following detailed description is stipulated as an unlimited illustration of the present invention.

The method for physical exercises and particularly for training of the movements "jump-squat" respectively "jump" and "squat", according to the invention, consists in that the person which trains carried out series of constantly and alternatively subsequent jumps and squats stimulated by automatically and alternately subsequent and arriving obstacles at the spot for training. The said obstacles are at different heights in regard to the spot for training, i.e. lower obstacle that compels the person which trains to perform a jump and upper obstacle that compels the person which trains to perform squat. Each obstacle performs a circular motion around axle "Z" and describes own plane parallel to plane "XY", as the distance between planes, described by the obstacles, may be regulated. The rhythm of the jumps and squats is defined by the preliminary disposition of the obstacles relative to one another or by the chosen angular speed of their rotation, as the obstacles always are chase one another, which dictates, as the change of the exercise from jump toward squat and vice versa so and the dynamics of the said change. The angular speed of rotation varies from 5 to 40 v/min for a "jump-squat" cycle.

Example 1

At a FIG. 1 is given one example of embodiment of the device for physical exercise according to the invention, in short further called "training machine", in particular for a training of the motion "jump-squat" from spot. As shown in FIG. 1 the training machine comprises a vertical console 1, a basis 2, lower bushing 3, carrying mechanism for jump 4, and upper bushing 5, carrying mechanism for squat 6. The basis 2 is unmovable fastened to the floor of premise for training or to the ground when the training machine will be used for training outside. The vertical console 1 has round section and is mounted on the basis 2 so that to provide solidity and unity of the whole structure. The lower bushing 3 is placed on the console 1 at its lower end, above the base 2 and is provided with notch 7 via which enters mechanism for jump 4, in its quantity of lower obstacle. Respectively, the upper bushing 5 is placed on the console 1 at its upper end and is provided with analogical notch 7' via which enters mechanism for squat 6, in its quantity of a upper obstacle. Both bushings—the lower 3 and the upper 5 are connected immovably one with another through a intermediate bushing 8 and are mounted to the vertical console 1 through bearings supports 9 and 9' (FIG. 2) with possibility for rotating around the vertical console 1.

The mechanism for jump 4 and the mechanism for squat 6 are placed antipodal relative to one another, so that during rotation bushings 3 and 5 they are chasing one after another in regard to the position in which is the person which trains, and this it makes to carried out a jump or a squat depending on the first arriving mechanism that appears an obstacle for the person that must be overcome either as jump over it, when the mechanism for jump 4 approaches, or to squat when the mechanism for squat 6 approaches. Provided is the mechanism for jump 4 and the mechanism for squat 6 to be manufactured by light material so that do not harm the person which trains, eventually at touch due to unsuccessful jump or squat. Again with the same end, the parts of the both mechanisms 4 and 6, with which is possible collision are covered with soft casings 10 and 10', respectively.

Constructively, the mechanism for jump 4 is performed in the form of a tube bent at an angle bigger than 90°, as one arm of the so resulting bent tube is disposed into the notch 7 of the lower bushing 3, while the other arm is free and lies in a plane parallel to the floor and is an obstacle requiring a jumping, while mechanism for squat 6 constructively is performed as a straight tube that enters into the notch 7' and is an obstacle requiring a squat.

In FIG. 2, that illustrates the device—a training machine, in a longitudinal section, are seen: a system for drive of the training machine 11, a lower system for adjustment 20, a upper system for adjustment 26 and system for emergency stop 29.

The system for drive of the training machine 11 is intended to secure the start, the rotation and the stopping of the movements of the jump and squat mechanisms 4 and 6, respectively of the bushings 3 and 5, and comprises: the electric motor with in-built solenoid brake 12 and reducer 13, disposed at the lower end of console 1, over the basis 2, microprocessor control 14 and a command panel 15. Physically, the command panel 15 is outside the sweep of the mechanisms for jump and squat 4 and 6, for example a "start-stop" device for a wireless remote control, attached, for instance, to the belt of the person that trains in order to provide its independence. The command panel 15, furthermore, duplicates the starting and stopping of the training machine, the visual establishing and reading of the established "jump-squat" cycles and the showing the instantaneous value of the pre-set speed for their execution. To the outgoing shaft of the reducer 13 is mounted a drive gear 16 engaged with a driven gear 17 coaxially disposed on the vertical console 1 via a bearing support 18. The driven gear 17 is connected to the lower end of the lower bushing 3 through a friction clutch 19, which clutch 19 is connected and with the lower bushing 3. As result, the rotary motion of the drive gear 16 is transmitted to the driven gear 17, so that both bushings 3 and 5 are actuated simultaneously.

The lower system for adjustment 20 is designed for adjusting the height of the mechanism for jump 4 of the device, according to the invention, and is disposed in the range of the lower bushing 3. With view to a better visualization, in FIG. 3 the said system is illustrated in enlarged kind. In fact, said system determines the power, respectively, the size of the jump and includes: a lower bearing bush 21 to which is mounted the passing through the notch 7 end of the bent tube of the mechanism for jump 4, a lower guide 22, disposed along the length of the lower bushing 3 and fastened to it by fasteners—inside console 46 and lateral console 47, and passing through the lower bearing bush 21, supporting bushing 23, disposed over the lower bearing bush 21 in the range of the lower guide 22, and provided with an set screw 24, a tension spring 25 whose lower end is fastened to lateral console 47 of the lower bearing bush 21, and the upper—to the inside console 46 of the lower bushing 3. The lower bearing bush 21 and supporting bushing 23 can be moved along the length of the lower guide 22, as in case of tightening of the set screw 24 towards the lower guide 22, the supporting bushing 23 restrains the possibility of movement upwards of the lower bearing bush 21, respectively of the mechanism for jump 4. The regulation of the height of the jump becomes by sliding of the supporting bushing 23, with the mounted in it set screw, upwards or downwards along the lower guide 22 till reaching the desired position of the mechanism for jump 4 in regard to the floor, and in this position, supporting bushing is locked with the said set screw 24. The parameters of the spring 25 are chosen so that in normal position the lower bearing bush 21 is always propped to the supporting bushing 23 and at the same time does not limit the movement of the mechanism for jump 4 in direction downward toward the floor, which is a convenience when the mechanism be overlapped unknowingly.

The upper system for adjustment 26 is designed for adjusting the height of the mechanism for squat 6 of the device according to the invention, and is disposed in the range of the upper bushing 5, antipodal in regard to the lower system for adjusting 20. With view to a better visualization, in FIG. 4 the said system is illustrated in enlarged kind. In fact, said system determines the power, respectively, size of the squat and includes: upper bearing bush 21', disposed in the upper bushing 5, to which is fastened, passing through the notch 7', end of the mechanism for squat 6, upper guide 22', passing through the upper bearing bush 21', disposed along of the upper bushing 5 and fastened through fixing elements toward the upper bushing 5, and set screw 24'. The upper bearing bush 21' can be moved along the upper guide 22' and fixed to it with the set screw 24', as in this way the height of the mechanism for squat 6 is adjusted with regard to the floor.

In FIG. 5 is presented one variant of embodiment of the mechanism for squat 6'. In this variant. constructively, the straight tube of the mechanism for squat 6' is connected with the upper bearing bush 21' through a swivel 27, comprising: first arm 41, connected to the straight tube of the mechanism for squat 6', and equipped with first upper support 42, a second arm 43, connected with the upper bearing bush 21', whose lower end forms specifically shaped lower support 44, disposed under the swivel, and its upper end is equipped with second upper support 45, and a compression spring 28, fastened between both supports 42 and 45, respectively. The swivel 27 allows, in case of pressure on the mechanism for squat in upwardly, for instance, pressure caused by the head of person that trains, when standing, the mechanism for squat 6' to rotate around the swivel 27, as compression spring 28 presses the arm 41 towards the lower support 44, that on its part obstruct the rotation down.

It is envisioned, the limits in which the heights of the mechanisms for jump and squat 4 and 6 to be adjusted in regard to the training spot, to be in the range of one maximum human height, for example 2 m.

The system for an emergency stop 29, for a better visualization, is shown in FIG. 6 in enlarged kind. It is designed for an emergency stop of the training machine in case that the person which trains with leg or head hooked any of mechanisms for jump or squat 4 and 6, respectively. This system comprises: said friction clutch 19, which connects mechanically the driven gear 17 with the lower bushing 3, one first inductive sensor 30, designed for reading of the change in rotational speed, a second inductive sensor 31, designed for indicating the set number of "jump-squat" cycles, a toothed disk 32 (FIG. 7), coaxially disposed to the vertical console 1, which works together with the pair of sensors 30 and 31, and is mounted to one disk for keeping 33 of friction clutch 19, respectively to the lower 3/upper 5 bushings of the training machine. Both sensors 30 and 31, are mechanically connected to the basis 2, and electrically—to said microprocessor control 14. The training machine stops emergency, at a turn on the electromagnetic brake of the electric motor 12, which happens when a signal from the first inductive sensor 30 is received, which shows sharply decreasing of the rotational speed of the bushings 3 and 5, or interruption of the rotation.

For ensuring the stability of the torque, transmitted through the friction clutch 19, the latter includes: a leading disk 34, which by means of springs 35 is pressed to the driven disk 33, mounted to the lower surface of the lower bushing 3 and rotates simultaneously with it. Said leading disk 34 is movable mounted into the cylindrical part of the bushing 36 with possibility to be moved along its longitudinal axis, and without possibility for reciprocal rotation between them, which is prevented by pins 39 to the upper front surface of the bushing 36, placed into the canals of the leading disk 34. The springs 35 are equipped at their lower ends with spherical nozzles 37 via which they are contacted with an regulating nut 38, rolled on the threaded section of the bushing 36. The regulating nut 38 is designed for changing the force of tension of the springs 35, which on its part regulates the pressure force between the two disks 33 and 34, and this changes the maximal resistant/torque at which friction clutch 19 is slid. The front surface of the adjusting nut 38 is provided with cone beds with diameter and depth corresponding to these of the spherical nozzles 37 and number corresponding to the number of the spherical nozzles 37. The falling the spherical nozzles 37 into the cone beds prevents the unreeling of the regulating nut 38 and this provides stability to the torque transmitted through the friction clutch 19.

Training process, according to the invention on Example 1, is illustrated in FIG. 8 and is done in the following manner:

the height of the mechanism for jump 4 is adjusted as well as the height of the mechanism for squat 6 in accordance with the described in Example 1 manner;

the person that trains stands on the spot for jumping—position "a" and through the command panel 15 or from "start-stop" device it switches the electrical supply, adjusts the number of "jump-squat" cycles, chooses the rotation speed and launches the electric motor 12, at this the mechanisms for jump and squat 4 and 6 begin to rotate;

firstly arriving mechanism according to the illustrations in FIG. 8 is this for jump—position "b" and person which trains performs jump in order to overcome the obstacle, approaching its feet, i.e. mechanism for jump 4, as the jump force is such that the feet do not touch it;

follows landing of the person which trains—position "c", where the mechanism for squat 6 approaches;

the person which trains performs a squat—position "d" in order the approached obstacle to pass above its head, i.e. the mechanism for squat—6, as the squat force is such that the its head does not touch it.

With this is finishing one cycle of the "jump-squat" exercise, in accordance with the invention.

The training process is repeated multiple till the stoppage of the device—training machine, with the control panel 15, or with the "start-stop" device.

The invention claimed is:

1. A training device for physical exercises, comprising:

a vertical monolithic console connected with a base and fastened to a floor;

a lower bushing disposed on the console at a lower end above the base;

an upper bushing disposed on the console at an upper end and connected immovably with the lower bushing through an intermediate bushing and bearing supports;

a mechanism for jump passing into the lower bushing through a first notch;

a mechanism for squat passing into the upper bushing through a second notch;

a lower system for adjustment disposed into the lower bushing and connected with the mechanism for jump;

an upper system for adjustment disposed into the upper bushing and connected with the mechanism for squat;

a system for drive disposed on the base and connected with the lower bushing by a pair of gears and a friction clutch; and a system for emergency stop connected with the system for drive, wherein the lower system for adjustment is disposed inside the lower bushing and comprises:

a lower guide, connected immovably at its both ends with the bushing, an inside console connected immovably at an upper end of the lower guide, a lateral console connected with an upper end of a lower bearing bush surrounding the lower guide, a supporting bushing with a set screw surrounding the lower guide and disposed above the lower bearing bush for setting a pre-set height, and a tension spring disposed between the inside console and the lateral console.

2. The device according to claim 1, wherein the mechanism for jump and the mechanism for squat are disposed antipodal in regard to one another.

3. The device according to claim 1, wherein the mechanism for jump is in a form of a tube and bent at an angle greater than 90°, wherein one end of the mechanism for jump goes into the first notch of the lower bushing and is fastened to the lower bushing through a lower bearing bush, and wherein the other end of the mechanism for jump is free and is covered with a soft casing, the mechanism for jump being disposed in parallel of a training spot.

4. The device according to claim 1, wherein the mechanism for squat is a straight tube, wherein one end of the mechanism for squat goes into the second notch of the upper bushing and is fastened to the upper bushing through an upper bearing bush, and wherein the other end of the mechanism for squat is free and is covered with a soft casing.

5. The device according to claim 4, wherein the straight tube of the mechanism for squat is connected with the upper bearing bush through a swivel.

6. The device according to claim 5, wherein the swivel includes:

a first arm with a first upper support, and a second arm with a lower end that forms a lower support disposed under the swivel and an upper end that forms a second upper support, wherein between the first and second upper supports is disposed a compression spring.

7. A training device for physical exercises, comprising:

a vertical monolithic console connected with a base and fastened to a floor;

a lower bushing disposed on the console at a lower end above the base;

an upper bushing disposed on the console at an upper end and connected immovably with the lower bushing through an intermediate bushing and bearing supports;

a mechanism for jump passing into the lower bushing through a first notch;

a mechanism for squat passing into the upper bushing through a second notch;

a lower system for adjustment disposed into the lower bushing and connected with the mechanism for jump;

an upper system for adjustment disposed into the upper bushing and connected with the mechanism for squat;

a system for drive disposed on the base and connected with the lower bushing by a pair of gears and a friction clutch; and a system for emergency stop connected with the system for drive, wherein the system for drive includes:

an electric motor with in-built solenoid brake and a reducer disposed at the lower end of the console, a drive gear connected with an outgoing shaft of the reducer, and a driven gear placed at the lower end of the console, coaxially to it, through a bearing support and coupled with the drive gear, wherein the friction clutch mechanically connects the driven gear with the lower bushing of the training device, and wherein the friction clutch includes ordered coaxially on the vertical console, between the driven gear and the lower end of the lower bushing:

a bushing, a leading disk with longitudinal channels mounted movably into a cylindrical part of the bushing, rotating simultaneously with it and pressed with springs towards a driven disk, the driven disk mounted to a lower surface of the lower bushing, pins of an upper front surface of the bushing disposed into the channels of the leading disk, and a regulating nut rolled up on a threaded section of the bushing as the springs at their lower ends have spherical nozzles in contact with conic beds disposed on an upper surface of the regulating nut.

8. The device according to claim 7, wherein a diameter and a number of the conic beds match a diameter and a number of the spherical nozzles.

9. The device according to claim 8, wherein the system for the emergency stop includes:

a toothed disk disposed coaxially on the vertical console and mounted to the driven disk of the friction clutch, and a first inductive sensor and a second inductive sensor, wherein the first and second inductive sensors operate together with the toothed disk, as both sensors are mechanically connected with the base and electrically connected with a microprocessor control that receives a signal for an emergency stop from the first inductive sensor, reporting a rotation speed of the lower and upper bushings.

10. A training device for physical exercises, comprising:

a vertical monolithic console connected with a base and fastened to a floor;

a lower bushing disposed on the console at a lower end above the base;

an upper bushing disposed on the console at an upper end and connected immovably with the lower bushing through an intermediate bushing and bearing supports;

a mechanism for jump passing into the lower bushing through a first notch;

a mechanism for squat passing into the upper bushing through a second notch;

a lower system for adjustment disposed into the lower bushing and connected with the mechanism for jump;

an upper system for adjustment disposed into the upper bushing and connected with the mechanism for squat;

a system for drive disposed on the base and connected with the lower bushing by a pair of gears and a friction clutch; and a system for emergency stop connected with the system for drive, wherein the upper system for adjustment is disposed inside the upper bushing and comprises:

an upper guide connected immovably in its both ends with the upper bushing, and a supporting bushing with a set screw connected immovably with a lower end of an upper bearing bush, the upper bearing bush surrounding the upper guide as an upper end of the upper bearing bush is connected with the mechanism for squat.

11. The device according to claim 10, wherein the mechanism for jump and the mechanism for squat are disposed antipodal in regard to one another.

12. The device according to claim 10, wherein the mechanism for jump is in a form of a tube and bent at an angle greater than 90°, wherein one end of the mechanism for jump goes into the first notch of the lower bushing and is fastened to the lower bushing through a lower bearing bush, and wherein the other end of the mechanism for jump is free and is covered with a soft casing, the mechanism for jump being disposed in parallel of a training spot.

13. The device according to claim 10, wherein the mechanism for squat is a straight tube, wherein one end of the mechanism for squat goes into the second notch of the upper bushing and is fastened to the upper bushing through an upper bearing bush, and wherein the other end of the mechanism for squat is free and is covered with a soft casing.

14. The device according to claim 13, wherein the straight tube of the mechanism for squat is connected with the upper bearing bush through a swivel.

15. The device according to claim 14, wherein the swivel includes:

a first arm with a first upper support, and a second arm with a lower end that forms a lower support disposed under the swivel, and an upper end that forms a second upper support, wherein between the first and second upper supports is disposed a compression spring.

* * * * *